US010625219B2

(12) United States Patent
Bandixen et al.

(10) Patent No.: US 10,625,219 B2
(45) **Date of Patent: *Apr. 21, 2020**

(54) BEVERAGE INFUSION SYSTEM, METHOD AND APPARATUS

(71) Applicant: BUNN-O-MATIC CORPORATION, Springfield, IL (US)

(72) Inventors: Mark W. Bandixen, Springfield, IL (US); Sheryl Dyer, Springfield, IL (US); Donald E. Wiley, Springfield, IL (US)

(73) Assignee: Bunn-O-Matic Corporation, Springfield, IL (US)

( * ) Notice: Subject to any disclaimer, the term of this patent is extended or adjusted under 35 U.S.C. 154(b) by 182 days.

This patent is subject to a terminal disclaimer.

(21) Appl. No.: 15/664,810

(22) Filed: Jul. 31, 2017

(65) Prior Publication Data

US 2017/0326508 A1 Nov. 16, 2017

Related U.S. Application Data

(63) Continuation of application No. 14/783,992, filed as application No. PCT/US2014/033778 on Apr. 11, 2014, now Pat. No. 9,718,035.

(60) Provisional application No. 61/811,094, filed on Apr. 11, 2013.

(51) Int. Cl.

| | |
|---|---|
| ***B01F 3/04*** | (2006.01) |
| ***B01F 5/04*** | (2006.01) |
| ***B01F 5/06*** | (2006.01) |

(52) U.S. Cl.

CPC ..... *B01F 3/04787* (2013.01); *B01F 3/0446* (2013.01); *B01F 5/0451* (2013.01); *B01F 5/0463* (2013.01); *B01F 5/061* (2013.01)

(58) Field of Classification Search

CPC .. B01F 3/04787; B01F 3/0446; B01F 5/0451; B01F 5/0463; B01F 5/061

USPC .... 261/76, DIG. 7; 222/129.1, 145.5, 145.6, 222/146.6; 426/477

See application file for complete search history.

(56) References Cited

U.S. PATENT DOCUMENTS

| | | | |
|---|---|---|---|
| 2,628,825 | A | 2/1953 | Kantor et al. |
| 3,617,032 | A | 11/1971 | Tracy |
| 4,187,262 | A | 2/1980 | Fessler et al. |
| 4,216,879 | A | 8/1980 | McMillin |
| 4,749,580 | A | 6/1988 | Demyanovich |

(Continued)

FOREIGN PATENT DOCUMENTS

| | | |
|---|---|---|
| CN | 1665584 | 9/2005 |
| CN | 1942238 | 4/2007 |

(Continued)

*Primary Examiner* — Charles S Bushey

(74) *Attorney, Agent, or Firm* — Barnes & Thornburg LLP

(57) ABSTRACT

Disclosed is a beverage dispensing machine and a gas infused beverage dispensing system which facilitates combination of gas with in a configuration which provides a smaller footprint and provides gas infusion of a beverage on demand. The system may be configured to produce only gas infused beverage or to allow the user to select gas infused beverage or chilled beverage, and, alternatively, ambient, unchilled beverage. A gas infuser of the system introduces gas to a chilled beverage stream using an injector with slots. This inline, on-demand gas infusion system provides benefits over infusion tank systems that gas infuse a relatively large volume of beverage in bulk.

17 Claims, 7 Drawing Sheets

(56) References Cited

U.S. PATENT DOCUMENTS

| | | | | |
|---|---|---|---|---|
| 5,115,942 | A | 5/1992 | Merrill et al. | |
| 5,743,433 | A | 4/1998 | Hawkins et al. | |
| 5,842,600 | A | 12/1998 | Singleterry et al. | |
| 6,463,753 | B1 | 10/2002 | Haskayne | |
| 8,177,197 | B1 | 5/2012 | Ergican | |
| 9,718,035 | B2 * | 8/2017 | Bandixen | B01F 5/0451 |
| 2004/0065680 | A1 | 4/2004 | Schroeder | |
| 2007/0114681 | A1 | 5/2007 | Romanyszyn | |
| 2014/0305316 | A1 | 10/2014 | Sevcik | |

FOREIGN PATENT DOCUMENTS

| | | |
|---|---|---|
| CN | 101687153 | 3/2010 |
| WO | WO 98/47812 | 10/1998 |
| WO | WO 99/15275 | 4/1999 |
| WO | WO 00/25904 | 5/2000 |
| WO | WO 00/53300 | 9/2000 |
| WO | WO 2012/006157 | 1/2012 |
| WO | WO 2013/003401 | 1/2013 |
| WO | WO 2013/006321 | 1/2013 |

* cited by examiner

BEVERAGE INFUSION SYSTEM, METHOD AND APPARATUS

CROSS REFERENCE TO RELATED APPLICATIONS

This application is a Continuation of U.S. patent application No. U.S. Ser. No. 14/783,992, filed Oct. 12, 2015, now U.S. Pat. No. 9,718,035, which is a U.S. nationalization under 35 U.S.C. § 371 of International Application No. PCT/US2014/033778, filed Apr. 11, 2014, which claims the benefit of priority under 35 U.S.C. § 119(e) to U.S. Provisional Patent Application No. 61/811,094, filed Apr. 11, 2013 Aug. 1, 2017. The disclosures set forth in the referenced applications are incorporated herein by reference in their entireties.

BACKGROUND

The present disclosure includes structures, methods, and systems for producing gas infused beverage on demand by controllably combining or infusing an uninfused beverage such as uncarbonated water with a gas such as carbon dioxide that is controllably dispensed and added to the uninfused beverage. The system includes structures that function to controllably introduce beverage into the system, devices for cooling or chilling the uninfused beverage, a gas infusing assembly, and a controller for controlling the operation of the system.

A variety of devices have been developed which combine water and carbon dioxide to produce a carbonated water beverage. Generally, these devices include soda fountain-type dispensers which produce large volumes of carbonated water for combination with flavoring to produce a carbonated beverage or "soda". Many of these large systems often include large carbon dioxide tanks remotely located relative to the dispenser and bag-in-box (BIB) flavor containers. The BIB containers are also similarly remotely located relative to the dispenser.

It would be useful to provide a carbonated beverage dispensing system which facilitates a combination of carbon dioxide with water in a configuration which provides a smaller footprint and reduces or eliminates dependency on remotely located carbon dioxide tanks and flavoring systems.

Additionally, it would be useful to develop a system which produces only carbonated water and allows the user to select carbonated water or chilled water, and alternatively ambient, unchilled water.

This background information is provided to provide some information believed by the applicant to be of possible relevance to the present disclosure. No admission is intended, nor should such admission be inferred or construed, that any of the preceding information constitutes prior art against the present disclosure. Other aims, objects, advantages and features of the disclosure will become more apparent upon reading of the following non-restrictive description of specific embodiments thereof, given by way of example only with reference to the accompanying drawings.

BRIEF DESCRIPTION OF THE DRAWINGS

The present disclosure will be described hereafter with reference to the attached drawings which are given as a non-limiting example only, in which.

Figure 1:
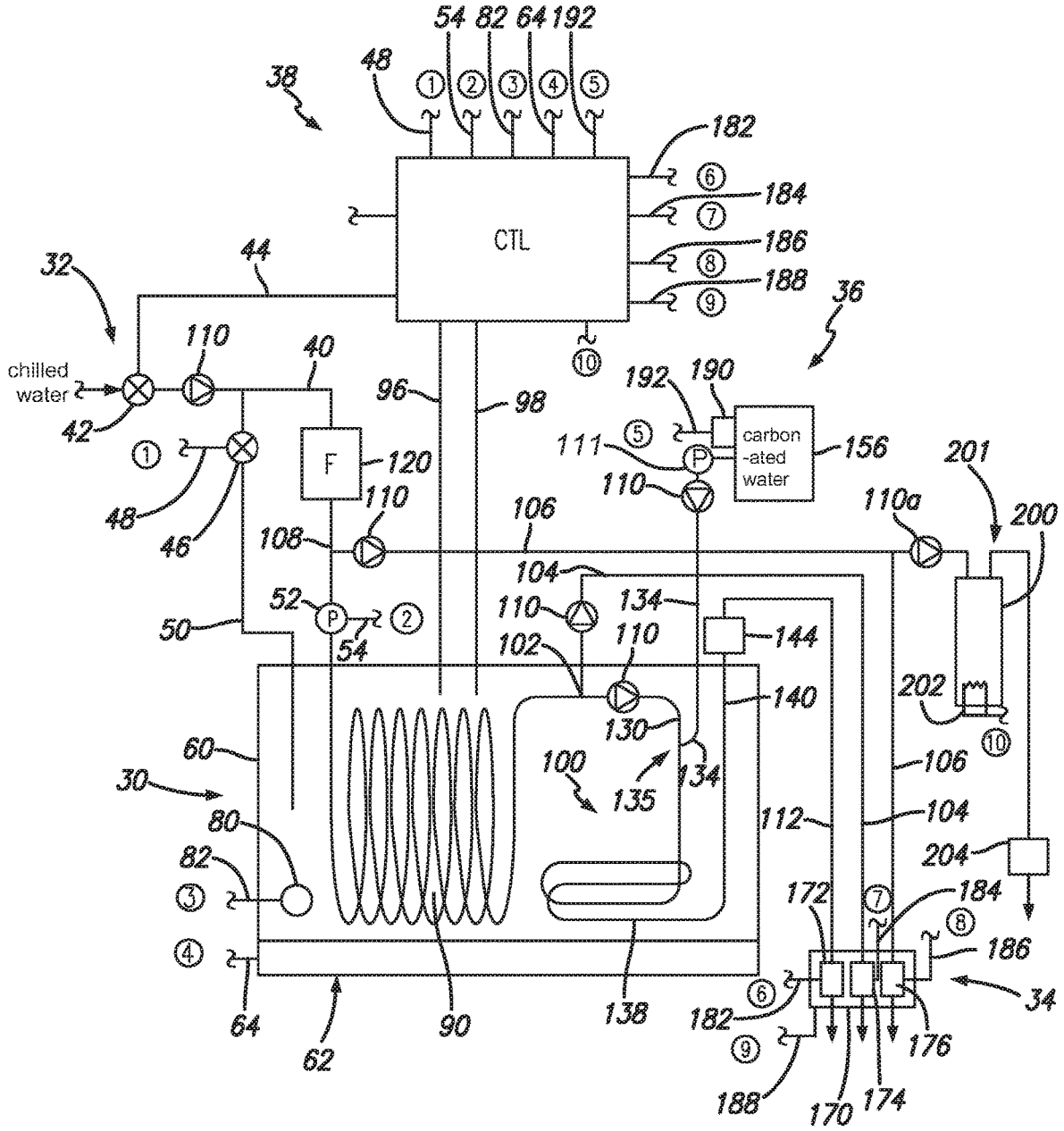
FIG. 1 is a illustrative system diagram of a beverage dispensing system that includes a device for cooling or chilling beverage including plumbing which facilitates chilling of beverage for dispensing directly as chilled water, dispensing in combination with gas to produce gas infused beverage, or dispensing of ambient beverage, including a controller to monitor and control the system.

The exemplification set out herein illustrates embodiments of the disclosure that are not to be construed as limiting the scope of the disclosure in any manner Additional features of the present disclosure will become apparent to those skilled in the art upon consideration of the following detailed description of illustrative embodiments exemplifying the best mode of carrying out the disclosure as presently perceived.

DETAILED DESCRIPTION

While the present disclosure may be susceptible to embodiment in different forms, there is shown in the drawings, and herein will be described in detail, embodiments with the understanding that the present description is to be considered an exemplification of the principles of the disclosure. The disclosure is not limited in its application to the details of structure, function, construction, or the arrangement of components set forth in the following description or illustrated in the drawings. The disclosure is capable of other embodiments and of being practiced or of being carried out in various ways. Also, it is to be understood that the phraseology and terminology used herein is for the purpose of description and should not be regarded as limiting. The use of various phrases and terms is meant to encompass the items or functions identified and equivalents thereof as well as additional items or functions. Unless limited otherwise, various phrases, terms, and variations thereof herein are used broadly and encompass all variations of such phrases and terms. Furthermore, and as described in subsequent paragraphs, the specific configurations illustrated in the drawings are intended to exemplify embodiments of the disclosure. However, other alternative structures, functions, and configurations are possible which are considered to be within the teachings of the present disclosure. Furthermore, unless otherwise indicated, the term "or" is to be considered inclusive.

Terms including beverage, brewed, brewing, brewing substance, brewed liquid, and brewed beverage as may be used herein are intended to be broadly defined as including, but not limited to, the brewing of coffee, tea and any other beverages. This broad interpretation is also intended to include, but is not limited to any process of dispensing, infusing, steeping, reconstituting, diluting, dissolving, saturating or passing a liquid through or otherwise mixing or combining a beverage substance with a liquid such as water without limitation to the temperature of such liquid unless specified. This broad interpretation is also intended to including, but is not limited to beverage substances such as ground coffee, tea, liquid beverage concentrate, powdered beverage concentrate, flaked, granular, freeze dried or other forms of materials including liquid, gel, crystal or other forms of beverage or food materials to obtain a desired beverage or other food product.

Beverages will be described in the present application and will be generally referred to as "water". However, it should be understood that the term beverage should be broadly interpreted regardless of reference to beverage as only water. Also, the characteristics or form of the beverage ingredients can be any variety of ingredients which are currently known or hereafter developed. The form of the beverage ingredient may include powder, liquid, gel, crystal, flake, freeze-dried and any other form or state regardless of temperature, phase or other characteristics. Reference to beverage dispensing includes reconstituting, brewing, steeping or any other form of combining a dilution ingredient with a beverage ingredient.

Moreover, while "beverage" is referred to, it is envisioned that any variety of food ingredients could be placed in the system to produce a carbonated beverage, chilled beverage, or ambient temperature beverage. While "water" is referred to for convenience throughout the application it should be understood that any variety of liquids could be used with the present application.

The foregoing terms as well as other terms should be broadly interpreted throughout this application to include all known as well as all hereafter discovered versions, equivalents, variations and other forms of the abovementioned terms as well as other terms. The present disclosure is intended to be broadly interpreted and not limited.

With reference to FIG. 1, the diagrammatic illustration of the system includes a water chilling assembly 30 or apparatus such as a water dispensing machine, an inlet line 32 which delivers water to the water chilling assembly 30, a dispensing assembly 34, a $CO_2$ assembly 36, and a controller 38. Water is introduced to the system through the inlet line 40 and it is controlled by an inlet valve 42. The inlet valve is coupled over line 44 to controller 38. A controllable valve 46 coupled to the controller over line 48 controllably adds water through the fill line 50 to the water chilling assembly, and a pump 52 coupled to the controller over line 54 helps to pump water though the system.

The water chilling assembly 30 includes a tank or water bath 60 which contains a volume of chilled heat transfer water or partially frozen ice bank. A temperature reducing assembly 62 is coupled to the controller over line 64. The temperature reducing assembly or cooling system 62 can be in the form of a Peltier device, a compressor 70 and heat transfer system which can include a fan 72. A recirculating pump 80 positioned in relation to the water bath 60 is coupled to the controller over line 82. The pump could be positioned in the tank or positioned outside of the tank with a component such as a tube extending into the tank. The recirculating pump 80 provides a mixing action that helps circulate water within the tank to facilitate heat transfer. A recirculation line may also be run alongside line 104 and 112 as a heat exchange to maintain chilled water dispense temperature.

Heat transfer is accomplished using the coil 90 which is a coiled path of the inlet line 40 so as to increase the contact area between the outside of the coiled tubular path 90 and the water flowing therethrough to help provide a reduced temperature volume of water for dispensing from the system. A water level detector 96 and a temperature sensor 98 are coupled to the controller to detect the level of water and temperature of the water in the tank. If a lower level of water is detected the controller will operate the inlet valve 46 to allow water to refill the tank 60 until the appropriate level is detected by the level detector 96. Additionally, since there is heat transfer occurring in the system a temperature sensor 98 is coupled to the controller 38. When the temperature is detected outside of a desired range, the cooling system 62 will be activated by the controller 38. When the temperature is within the predetermined range the controller 38 will deactivate the cooling system 62.

A carbonator assembly 100 is provided in association with the cooling assembly 30 to receive chilled water from the chilling coil 90 and introduce carbon dioxide into the flow of water at a mixing portion 135 as described below. It should be noted that a "T" 102 is provided to allow a path of water through water line 104 to be dispensed without the addition of carbonation. In other words, a chilled water line without carbonation is provided in water line 104 for dispensing of still, chilled water. Additionally, an ambient water line 106 can be provided by adding a "T" 108 to the inlet line before the chilling coil 90. Additionally, a check valve 110 is generally provided in each of the water lines chilled, still 104, ambient 106, and carbonated 112 to prevent backflow. The pump 52 provides positive pressurization of the line for the chilled water.

As shown on the far right side of FIG. 1 the ambient water line 106 can lead to another check valve 110*a* which delivers water to a heated water assembly 201 including a heated water reservoir 200. A heating element 202 is associated with the heated water reservoir 200 to heat the water retained in the reservoir. The heating element 202 is coupled to the controller 38. A dispense valve 204 can be in the form of a manually operated dispense valve or a controllable valve similar to those shown in other portions of this disclosure which are coupled to the controller 38. The heated water assembly 201 can be provided as a convenience to offer a complete water solution in combination with the chilled and ambient water portions of the system.

A filter system 120 can be provided in the inlet water path 40 so as to produce filtered water for dispensing. The filtered water will be dispensed through the ambient line 106, the chilled, still line 104 as well as the carbonated line 112. The use of a filtration device 120 can help facilitate enhanced carbonation by removing ingredients such as particles, some minerals, and some chemicals from the water which might otherwise result in carbonation evolving out of solution preventing or reducing uptake of carbonation in the water or allowing carbonation to evolve more quickly from the water. The filter 120 can be in the form of a replaceable cartridge connected to the line 140 or a cartridge housing in which replaceable cartridges can be inserted. This also allows for high quality, filtered, still water which does not include carbonation.

Figure 5A:
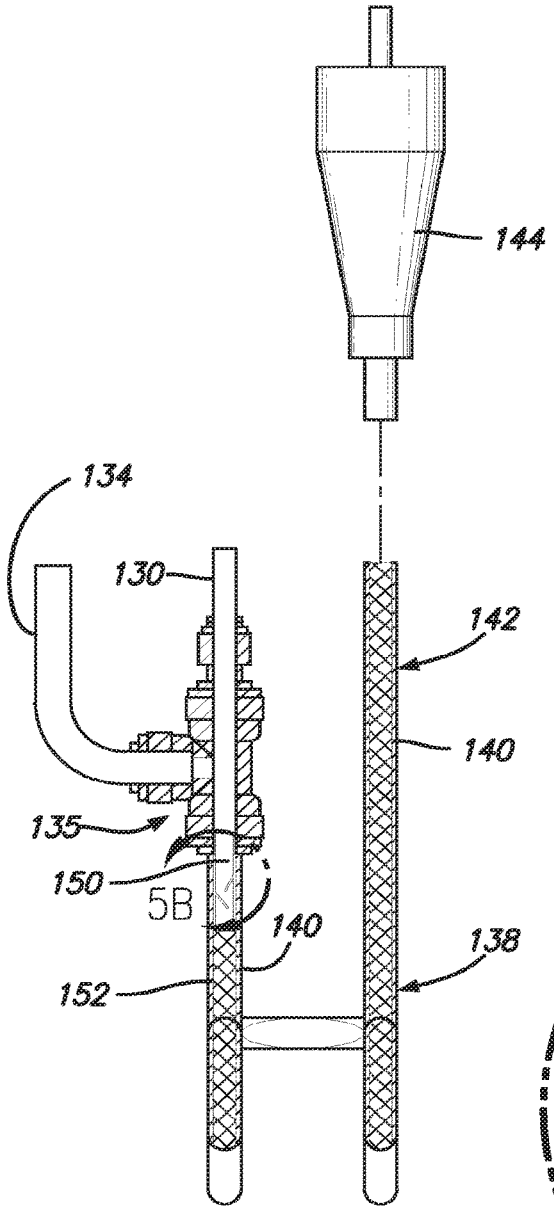
FIG. 5A is a cross sectional view taken along line 5A-5A in FIG. 4 showing structures within the static mixing section and the relative location of the beverage injector and gas inlet.

As shown in FIG. 5A, the carbonator assembly 100 includes a mixing portion 135 communicating with the inlet 130 where chilled water is introduced to the assembly, a $CO_2$ line 138 communicates with the mixing portion 135 and introduces carbonation to the water entering through water inlet 130. An outlet line 140 communicates with the mixing portion 135 and dispenses carbonated water there through. A looped length of the carbonator assembly tube 134 is provided to enclose a static mixing device 142. The static mixing device 142 provides a more circuitous path after carbon dioxide is introduced into the water flow to enhance the uptake of carbon dioxide into the water. The static mixing device 142 as shown is in the form of a spiral baffle or auger with multiple twists. While all the twists can be of one direction, clockwise or counterclockwise, a preferred embodiment will combine sections of clockwise auger twists with sections of counterclockwise auger twists. The combination of sections of counter oriented twists helps to increase the interaction of the carbon dioxide and water molecules passing through the system. While a version of the static mixer 142 is shown extending through the entire looped path 138, another embodiment of the invention uses only a portion of the looped path 138 containing a portion of the static mixer 142.

Placing the carbonator assembly 100 in the water bath 60 helps to enhance the uptake characteristics of the water. Water exits the carbonator assembly at outlet 140 which includes a flow restrictor 144. The flow restrictor 144 provides some degree of control and the back pressure of the flow from the assembly 100 to further enhance incorporation and dissolving of carbon dioxide into the water flow.

Figure 6:
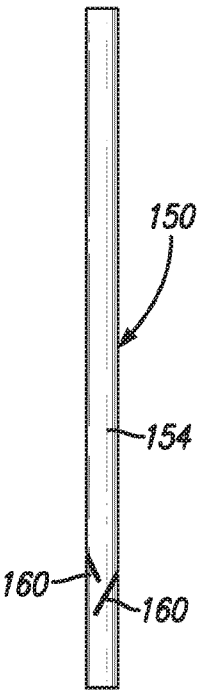
FIG. 6 is a view of the beverage injector used in the gas infusion assembly.
Figure 4:
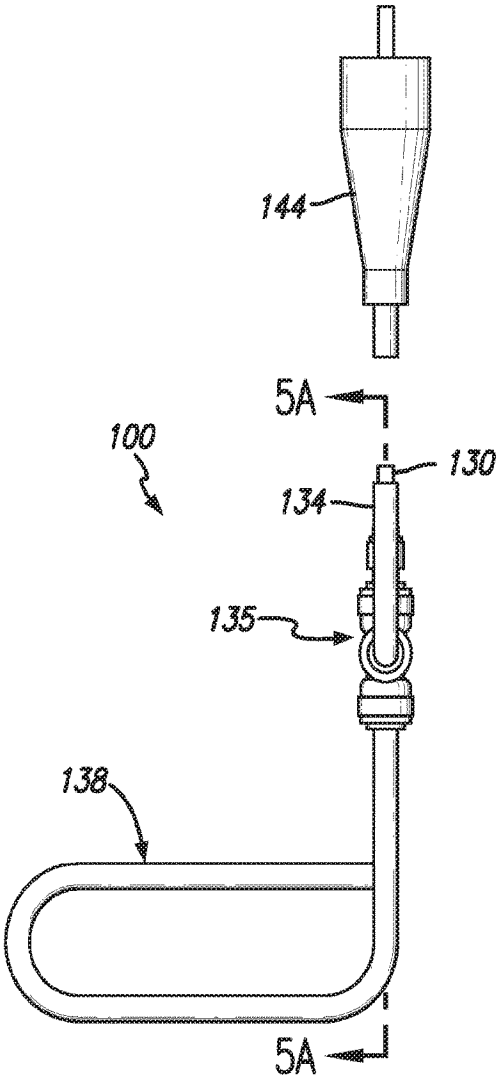
FIG. 4 is a right side view of the carbonator assembly shown in FIGS. 2 and 3.
Figure 3:
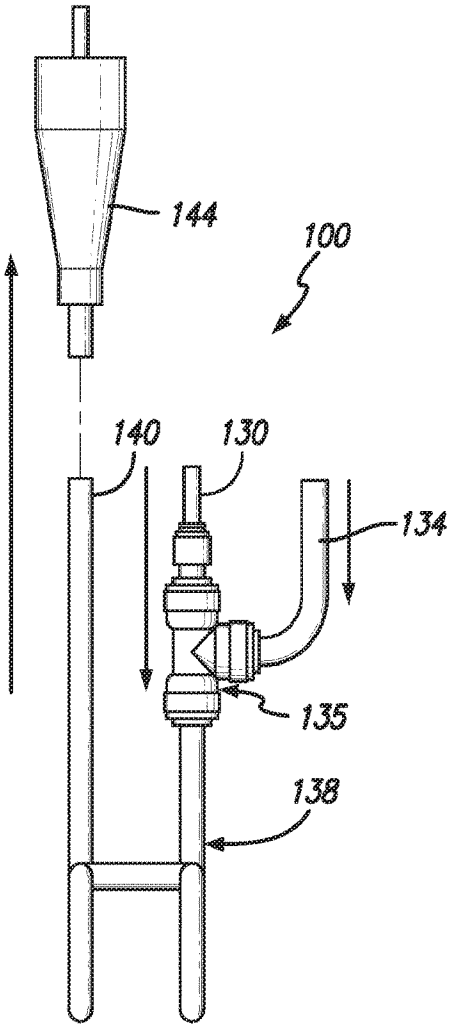
FIG. 3 is a front elevational view of the gas infusing assembly shown in FIG. 2.

With regard to FIG. 6, a water injector 150 is shown positioned in the mixing portion 135. The water injector is a tube which telescopes into a corresponding portion of the mixing portion 135 and the outlet line 140. As shown in the enlarged view of FIG. 5B, a space 152 is provided between the outside 154 of the water injector 150 and an inside 153 of the outlet line 140 and/or looped path 138. The carbon dioxide inlet 134 introduces carbon dioxide into this space 152. A carbon dioxide source such as a replaceable tank or other feed line 156 introduces carbon dioxide to the $CO_2$ inlet 134. The water injector 150 includes openings shown as angled slots 160. While two slots are shown in the current illustration additional slots could be used to produce additional flow characteristics. The slots are used as a way to produce an atomized flow of water entering into the $CO_2$ path. The combination of pressurized, atomized water and pressurized co-flowing carbon dioxide causes the carbon dioxide to be added to the water. Atomization of the water helps to break up the water flow providing more molecular surface contact between the water molecules and the carbon dioxide molecules to allow enhanced uptake of carbon dioxide into the water. After being combined in this $CO_2$ rich environment the combined flow continues through the static mixing section and mixing device 142 for a subsequent dispensing through the flow restrictor 144.

Figure 5B:
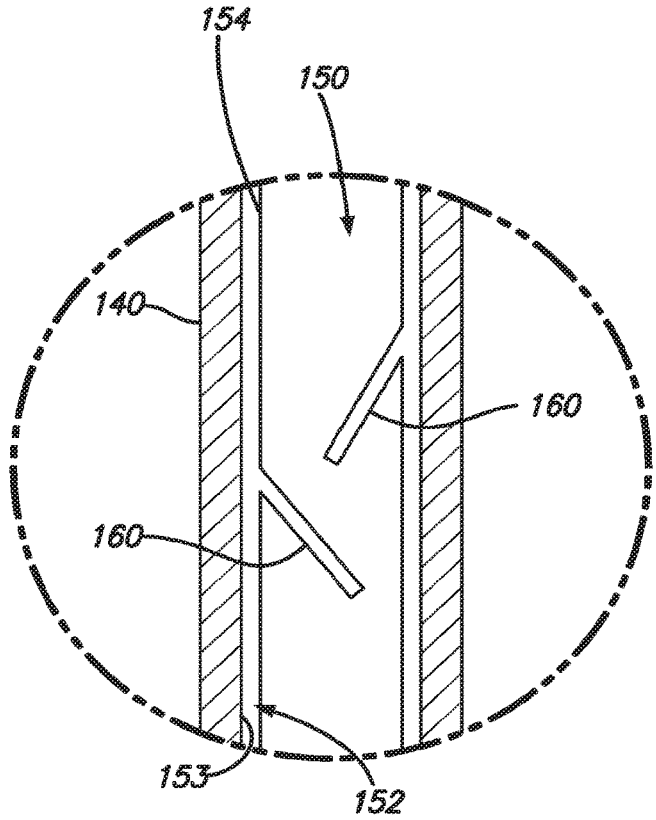
FIG. 5B is an enlarged view of a portion of FIG. 5A taking in the area 5B in FIG. 5A showing an enlarged view of the slots in the beverage injector portion of the gas infusing assembly and a space between an outside surface of the beverage injector and the inside surface of the corresponding tubular portion of the gas infusion assembly.

With reference to FIG. 5B, the slots 160 are approximately 0.010" wide and extended into the tube to provide a passage through which water can flow out of the water injector 150 and into the gap 152 for mixing with carbon dioxide. While the slots are shown as angling upward, or upstream to the flow through which the water is introduced to the mixing portion 135, relative to the orientation of the water injector 150, the slots could be generally perpendicular to an axis of alignment or be angled downwardly. It is proposed that the slots are angled upwardly to create a slight upstream flow of water emitted from the slots 160 into the pressurized generally all surrounding and generally downward flow of carbon dioxide through the gap 152. It is proposed that this counter flow enhances the interaction of the water with the carbon dioxide. Additionally, the slot 160 as shown may be preferable to apertures or circular holes because the slots tend to provide a fan sprayed atomized distribution of water into the carbonation flow. It is expected that this fanned flow of water helps to better disperse the water for combination with the carbon dioxide. While two slots 160 are shown additional slots could be used. It may be preferable to provide a balance to the orientation and distribution of water from the slots so as to help maintain a balanced water pressure for managing the combined water pressure and carbon dioxide pressure in the injector assembly 100.

One of the complications of properly carbonated water is the different sizes of the water molecules and the carbon dioxide molecules. The carbonator assembly 100 acts to force these different sized molecules together to provide some engagement between the carbon dioxide and water molecules. The water molecules tend to not naturally disassociate and as such the atomized or sprayed flow of water from the water injector 150 tends to layer water molecules in amongst the carbon dioxide molecules. This thin spreading of water helps to disassociate the water molecules, even temporarily, to help provide increased saturation of carbon dioxide in the water. Providing the water in a chilled condition helps to reduce the molecular vibration and enhance the combination of carbon dioxide and water molecules.

As shown in FIG. 5B, the gap 152 is formed between the differential of the outside diameter of the water injector and the inside diameter of the corresponding tube. A preferred embodiment of the injector assembly 100 includes a gap 152 of approximately 0.034". The gap may be larger or smaller depending upon the other characteristics including the pressure of the water flow, the atomization of the water flow, the temperature of the water flow, the pressure of the carbon dioxide, and the types of materials associated with the assembly. These and other factors may influence the ability of the water to absorb carbon dioxide.

The pressure of the system can be controlled by the combination of pressure increasing (pumps), flow restricting, and flow controlling features. As an example, with reference to FIG. 1, the pump 52 boosts the water pressure to match or exceed the carbon dioxide pressure. In a preferred embodiment, the target pressure is approximately equal to or greater than 100 PSI. A general operating range in a preferred embodiment is approximately 100-120 psi. However, pressures greater than 120 psi or less than 100 psi may also be used. Generally, the pressure of the water depends on the pressure of the carbon dioxide so that appropriate pressurized engagement of the carbon dioxide and water is achieved. In other words, the pressure in the gap 152 (see FIG. 5B) is balanced so that the water flowing out of the slots 160 and the carbon dioxide flowing from the carbon dioxide line 134 is balanced utilizing flow restrictor 144 (see, FIG. 2) so that there is flow, generally downstream, of both components. The flow restrictor 144 also helps to reduce the dispensed pressure and flow to provide a more even flow rate at the dispense point. This helps to provide a generally more uniform dispensing stream at a manageable flow rate to prevent excessive pressure from splashing within the user's cup or container or filling the cup too quickly.

A dispensing head or a dispensing location 170 is provided on the dispensing apparatus. The dispensing head 170 can provide an individual nozzle through which the three flow paths 104, 106, 112 flow or individual nozzles can be provided for each flow path. The use of the three flow paths and three nozzles as illustrated is only provided by way of convenience and clarity and not intended to be a limitation on the present disclosure. Additionally, while three control valves are illustrated (172, 174, 176) coupled to the controller 38 over lines 182, 184, 186 a single control valve combining control of the multiple paths could be provided as well. One of ordinary skill in the art possessing the present disclosure would be able to accomplish alternatives of this invention without undue experimentation. The present disclosure provides all the necessary disclosure and inspiration and motivation for achieving further enhancements as a result of this disclosure. The $CO_2$ device or container 156 is removable and may include a sensor 190 that can detect the condition of the $CO_2$ device. If the detector 90, coupled to the controller over line 192 detects a low level condition of the $CO_2$ it can alert the operator of the machine to refill and/or replace the container. A pressure regulator 111 can be used to set the $CO_2$ pressure.

The various components described herein have also been consistently marked and noted on the corresponding schematic diagram. As shown, a control switch 180 can be provided in connection with the operation of the dispense valves 172, 174. In the present embodiment of the schematic an ambient control valve has not been provided but could be without undue experimentation. Additionally, the control switches and solenoid valves are provided in a low volt configuration by means of the transformer 200.

Figure 2:
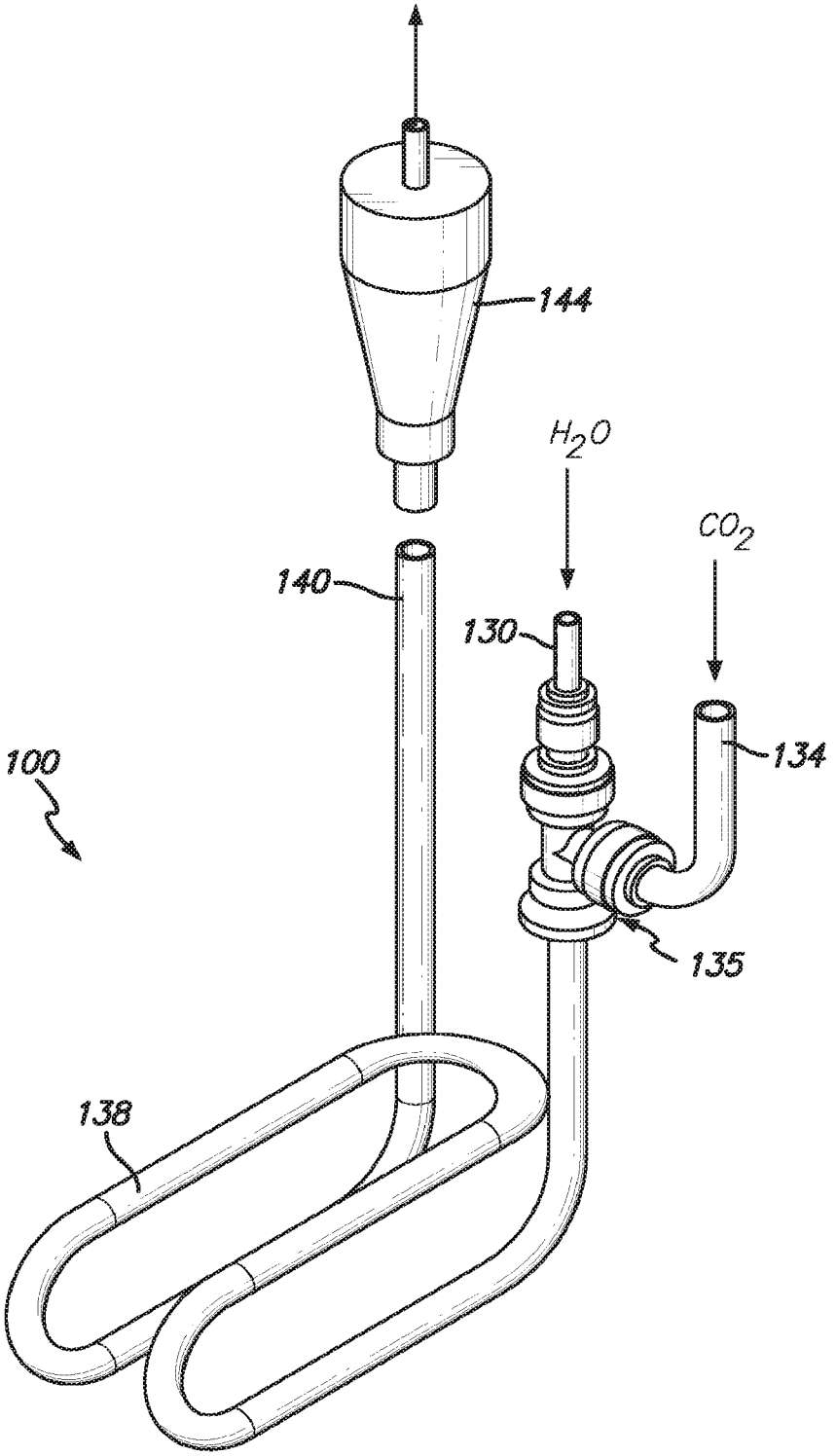
FIG. 2 is a perspective view of a gas infusing assembly showing a flow restrictor on an infused beverage outlet, a static mixing section, a beverage injector, and a gas inlet.
Figure 7:
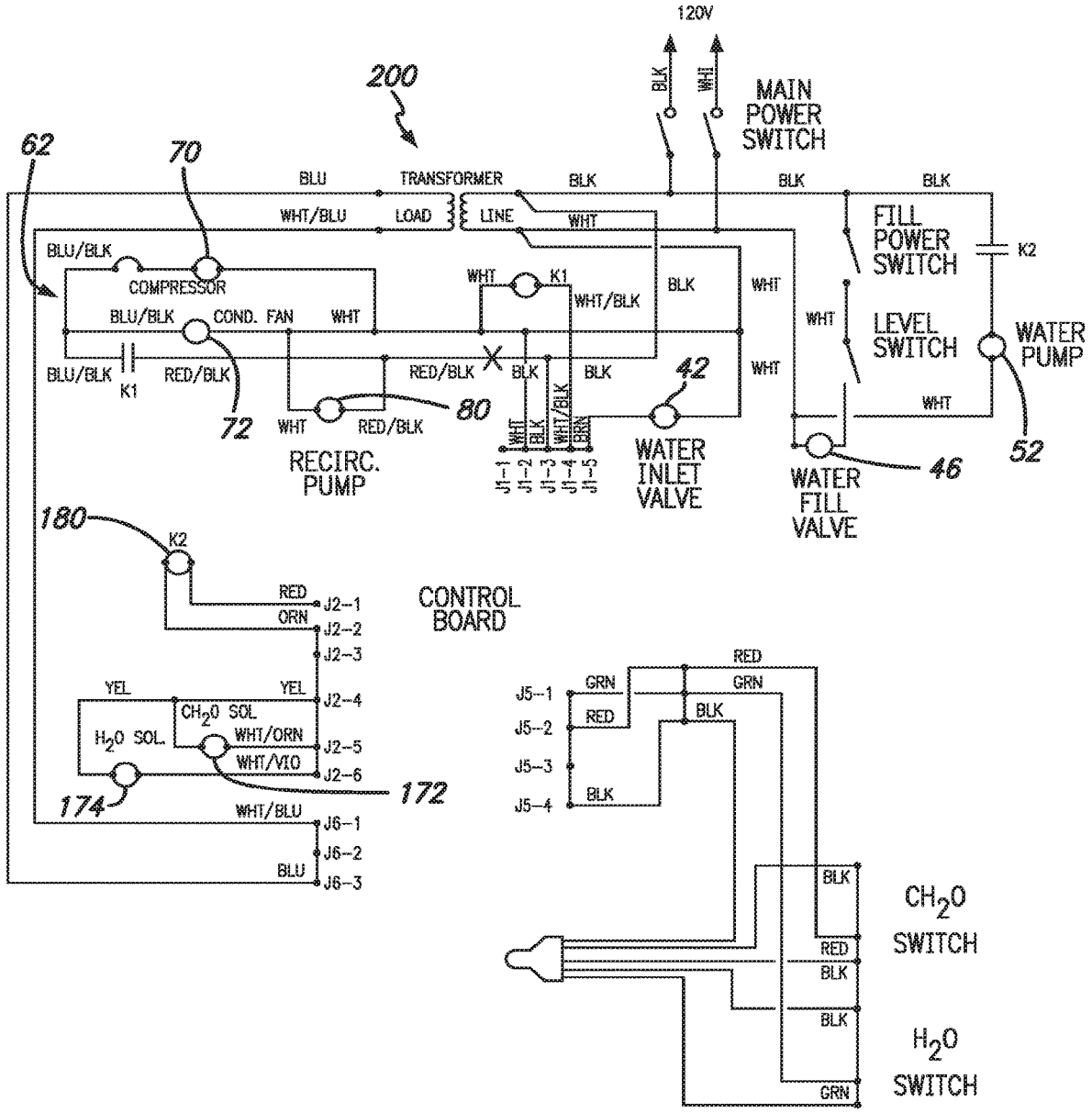
FIG. 7 is an electrical schematic of the system and the controller used with the system as shown in FIG. 1 providing additional details with regard to the block diagram representation of the controller in FIG. 1.

In use, the system as show in FIG. 1 includes the carbonator assembly 100 as shown in FIGS. 1, 2, and the diagrammatic illustration of FIG. 7. In order to dispense water from the system water is introduced through water line 40 by operation of the inlet control valve 42 connected to the controller 38. Water flows into the coil 90 where it is chilled by the contents of the tank 60. If the water level in the tank drops the level sensor 96 coupled to the controller 38 detects the level and provides a signal to the controller 38. The controller will open the refill valve 46 in response to a low level signal. Once the level returns within a desired range the level sensor 96 detects the desired level and the controller 38 deactivates the control valve to close the fill line 50 and prevent continued flow of water into the tank 60. While a contact level sensor 96 is illustrated any number of other level sensors to be used including optical, acoustic, conductive, inductive or any other number of systems that will provide a similar function. Use of a controller as shown is intended to be an illustration of such a sensor and not a limitation on such a sensor.

The temperature of the cooling assembly 30 is detected by a temperature sensor 98. A recirculating pump 80 moves water through the tank 60 to help enhance heat transfer between the coil 90 and the contents of the tank. A cooling system 62 is provided and operated over line 64 coupled to the controller 38.

Water flows from the coil 90 to the carbonator assembly 100. A separate line 104 is coupled to the coil 90 to provide chilled, still water. Water entering the carbonator assembly passes through a water injector 150. Carbon dioxide is introduced into the carbonator assembly 100 and is combined with water being passed through the slots 160 of the injector 150. The atomized or fractured water which is chilled is more conducive to taking up a significant portion of carbon dioxide to help create a carbonated water. The combination of carbon dioxide and water passes through the static mixing section 138 passing through the mixing portions to enhance the uptake of carbon dioxide in the water. Water flows from the carbonator assembly 100 through the flow restrictor 144 for dispensing.

Control valves 172 and 174 are coupled to the outlet end of the carbonated water and still water paths. These control valves are coupled to the controller for operative control by a user. As an additional option, an ambient still water path can be provided and dispensed at the same location. All water may also be additionally conditioned such as by use of a filter 120 which filters the water before it is chilled and/or carbonated.

Figure 8:
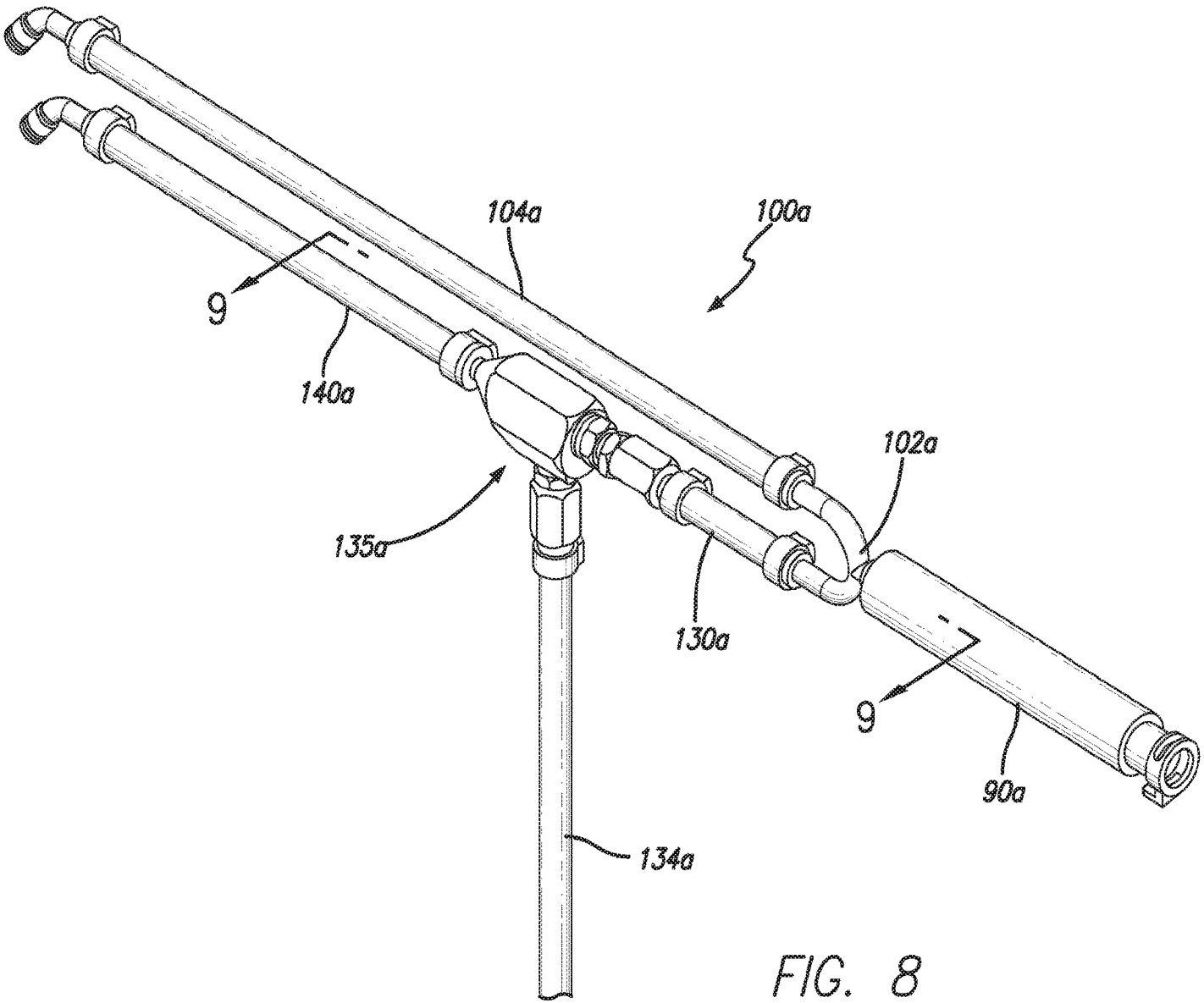
FIG. 8 is another embodiment of a gas infusion assembly similar to that as shown in FIG. 2, with the orientation of the beverage and gas lines being slightly differently configured than that as shown in FIG. 2, but generally consistent with the configuration disclosed in FIG. 1.
Figure 9:
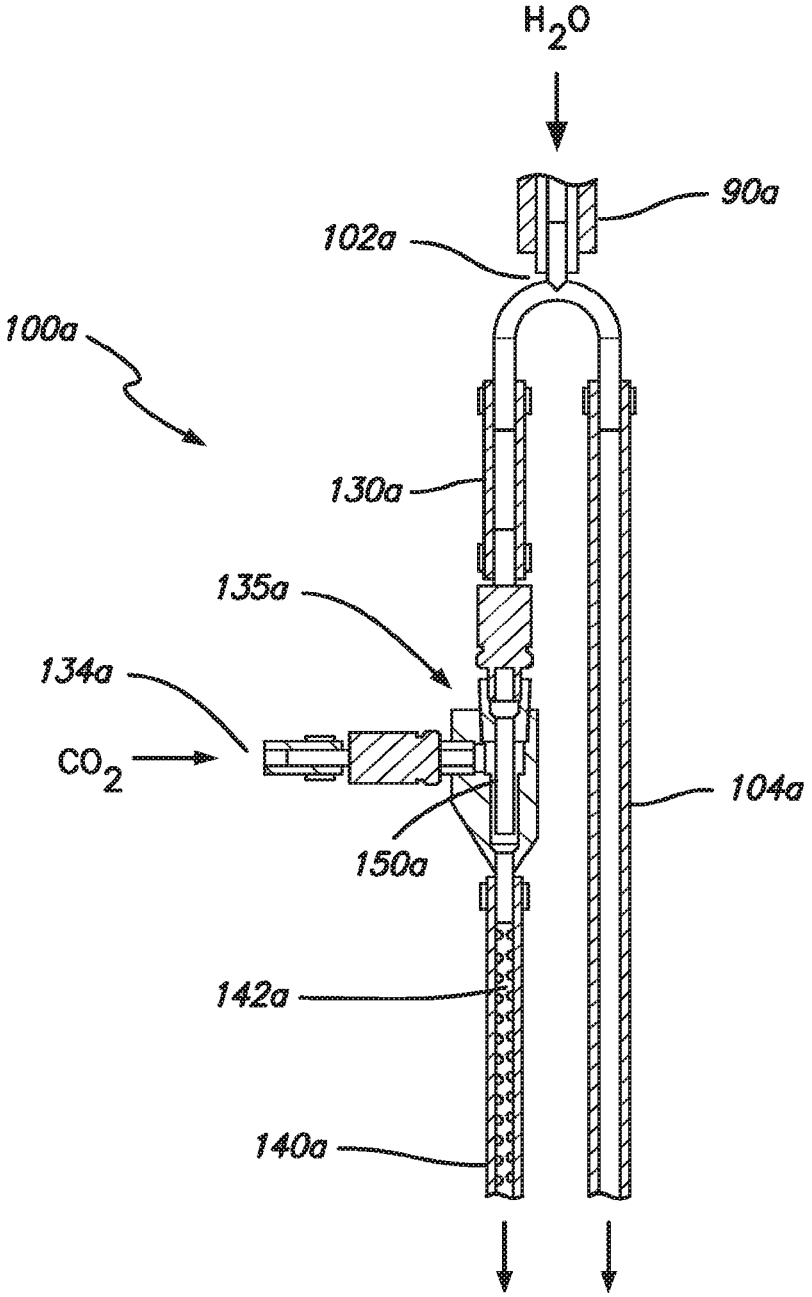
FIG. 9 is a cross sectional view taken along line 9-9 in FIG. 8 providing a cross sectional view similar to FIG. 5A showing a cross sectional view of a corresponding beverage injector, and with clarification being had by reference to FIG. 1.

FIGS. 8 and 9 show another embodiment of a carbonator assembly 100*a*. Reference to the structures as described throughout the preceding portion of the disclosure are referred to with the same reference numerals with the addition of the suffix "a".

As shown in FIG. 9, water is introduced through a line 90*a* which is coupled to the coil to help provide a reduced temperature volume of water for dispensing from the system. It should be noted that a "T" 102*a* is provided to allow a path of water through water line 104*a* to be dispensed without the addition of carbonation. In other words, a chilled water line without carbonation is provided in water line 104*a* for dispensing of still, chilled water.

A carbonator assembly 100*a* includes a mixing portion 135*a* communicating with the inlet line 130*a* where chilled water is introduced to the assembly 100*a*, a $CO_2$ line 134*a* introduces carbonation to the water entering through water line 130*a*. A static mixing device 142*a* provides a more circuitous path after carbon dioxide is introduced into the water flow to enhance the uptake of carbon dioxide into the water. The static mixing device 142*a* as shown is in the form of a spiral baffle or auger with multiple twists or intersections. This is generally the same type of mixing device as described in the preceding disclosure. An outlet path 140*a* is directed for dispensing and may include the flow restrictor 144 as shown in FIG. 1. This embodiment of the assembly provides a less complex configuration of the assembly which may be useful in some situations.

While the present disclosure describes various exemplary embodiments, the disclosure is not so limited. To the contrary, the disclosure is intended to cover various modifications, uses, adaptations, and equivalent arrangements based on the principles disclosed. Further, this application is intended to cover such departures from the present disclosure as come within at least the known or customary practice within the art to which it pertains. It is envisioned that those skilled in the art may devise various modifications and equivalent structures and functions without departing from the spirit and scope of the disclosure as recited in the following claims. The scope of the following claims is to be accorded the broadest interpretation so as to encompass all such modifications and equivalent structures and functions.

The invention claimed is:

1. A gas infusion assembly for use with a beverage dispensing system, the gas infusion assembly including a beverage inlet line, a gas line, a mixing portion, and a tubular outlet line;

the mixing portion including communication with the gas line, the beverage inlet line, and the tubular outlet line;

a tubular beverage injector in the mixing portion communicating with the beverage inlet line and being at least partially concentrically retained within a portion of the tubular outlet line, gas being controllably introduced into the mixing portion external to the tubular beverage injector;

the tubular beverage injector including openings to facilitate introduction of beverage into the gas flow and mixing of gas and beverage in a space provided between the outside of the tubular beverage injector and the inside of at least a concentric portion of the tubular outlet line for producing gas infused beverage to be dispensed from the tubular outlet line.

2. The gas infusion assembly as set forth in claim 1, wherein the openings in the tubular beverage injector further comprising slots formed in a wall of the tubular beverage injector.

3. The gas infusion assembly as set forth in claim 2, wherein the slots in the tubular beverage injector are directed in an orientation generally upstream of the flow of beverage from the inlet line to enhance the interaction between gas and beverage in the mixing portion.

4. The gas infusion assembly as set forth in claim 2, wherein the slots are approximately 0.010 inches wide.

5. The gas infusion assembly as set forth in claim 1, the tubular outlet line further including a static mixer to enhance the mixing and combination of gas and beverage.

6. The gas infusion assembly as set forth in claim 1, wherein beverage flows in a first direction in the tubular beverage injector and gas flows in a second direction opposite the first direction in the space.

7. The gas infusion assembly as set forth in claim 5, wherein the static mixer is coupled to the tubular outlet line and comprises a spiral baffle with a section of clockwise auger twists and a section of counterclockwise auger twists.

8. The gas infusion assembly as set forth in claim 5, further comprising a flow restrictor downstream of the static mixer.

9. A beverage dispensing machine having a gas infusion assembly, the gas infusion assembly including a beverage inlet line, a gas line, a mixing portion, and a tubular outlet line;

the mixing portion including communication with the gas line, the beverage inlet line, and the tubular outlet line;

a tubular beverage injector in the mixing portion communicating with the beverage inlet line and being at least partially concentrically retained within a portion of the tubular outlet line, gas being controllably introduced into the mixing portion external to the tubular beverage injector;

the tubular beverage injector including openings to facilitate introduction of beverage into the gas flow and mixing of gas and beverage in a space provided between the outside of the tubular beverage injector and the concentric inside of at least a portion of the tubular outlet line for producing gas infused beverage to be dispensed from the tubular outlet line.

10. The gas infusion assembly as set forth in claim 9, wherein the openings in the tubular beverage injector further comprising slots formed in a wall of the tubular beverage injector.

11. The gas infusion assembly as set forth in claim 10, wherein the slots in the tubular beverage injector are directed in an orientation generally upstream of the flow of beverage from the inlet line to enhance the interaction between gas and beverage in the mixing portion.

12. The gas infusion assembly as set forth in claim 10, wherein the slots are approximately 0.010 inches wide.

13. The gas infusion assembly as set forth in claim 9, the tubular outlet line further including a static mixer to enhance the mixing and combination of gas and beverage.

14. The gas infusion assembly as set forth in claim 9, wherein beverage flows in a first direction in the tubular beverage injector and gas flows in a second direction opposite the first direction in the space.

15. The gas infusion assembly as set forth in claim 13, wherein the static mixer is coupled to the tubular outlet line and comprises a spiral baffle with a section of clockwise auger twists and a section of counterclockwise auger twists.

16. The gas infusion assembly as set forth in claim 10, wherein the slots are approximately 0.010 inches wide.

17. The gas infusion assembly as set forth in claim 13, further comprising a flow restrictor downstream of the static mixer.

* * * * *